US009441562B2

(12) United States Patent
Odendall

(10) Patent No.: US 9,441,562 B2
(45) Date of Patent: Sep. 13, 2016

(54) METHOD FOR OPERATING AN INTERNAL COMBUSTION ENGINE AND CORRESPONDING INTERNAL COMBUSTION ENGINE

(71) Applicant: Audi AG, Ingolstadt (DE)

(72) Inventor: Bodo Odendall, Lenting (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/435,041

(22) PCT Filed: Oct. 12, 2013

(86) PCT No.: PCT/EP2013/003074

§ 371 (c)(1),
(2) Date: Apr. 10, 2015

(87) PCT Pub. No.: WO2014/056625

PCT Pub. Date: Apr. 17, 2014

(65) Prior Publication Data

US 2015/0260118 A1 Sep. 17, 2015

(30) Foreign Application Priority Data

Oct. 11, 2012 (DE) ..... 10 2012 019 907

(51) Int. Cl.
*F02D 41/00* (2006.01)
*F02D 41/02* (2006.01)
(Continued)

(52) U.S. Cl.
CPC ..... *F02D 41/0295* (2013.01); *F02D 35/0092* (2013.01); *F02D 41/1402* (2013.01);
(Continued)

(58) Field of Classification Search
CPC ..... F02D 41/0295; F02D 41/1456; F02D 41/1402; F02D 41/1455; F02D 41/2438; F02D 35/0092; F02D 2200/0814
See application file for complete search history.

(56) References Cited

U.S. PATENT DOCUMENTS 5,293,740 A 3/1994 Heppner et al.
6,062,019 A * 5/2000 Staufenberg ..... F02D 41/1441 60/274

(Continued)

FOREIGN PATENT DOCUMENTS

DE 41 28 718 3/1993
DE 601 15 303 6/2006

(Continued)

OTHER PUBLICATIONS

International Search Report issued by the European Patent Office in International Application PCT/EP2013/003074 on Mar. 31, 2014.

(Continued)

*Primary Examiner* — Hieu T Vo
*Assistant Examiner* — Sherman Manley
(74) *Attorney, Agent, or Firm* — Henry M. Feiereisen LLC

(57) ABSTRACT

A method for operating an internal combustion engine includes the steps of determining an oxygen filling state of an oxygen storage of a catalytic converter by way of a first lambda signal provided by a first lambda probe and an offset value, the first lambda probe being arranged in an exhaust gas stream upstream of the catalytic converter; when a second lambda signal provided by a second lambda probe arranged in the exhaust gas stream upstream of the catalytic converter falls below a lower lambda signal threshold, setting the oxygen filling state to a first value corresponding to an empty oxygen storage and/or when the second lambda signal exceeds a upper lambda signal threshold setting the oxygen filling state to a second value corresponding to a full oxygen storage; immediately thereafter regulating the oxygen filling state during at least one regulation time period to a target filling state; and after expiration of the regulation time period adjusting the offset value by way of the second lambda signal.

8 Claims, 2 Drawing Sheets

(51) Int. Cl.
*F02D 41/14* (2006.01)
*F02D 41/24* (2006.01)
*F02D 35/00* (2006.01)

(52) U.S. Cl.
CPC ..... *F02D41/1455* (2013.01); *F02D 41/1456* (2013.01); *F02D 41/2438* (2013.01); *F02D 2200/0814* (2013.01)

(56) References Cited

U.S. PATENT DOCUMENTS

| | | | | |
|---|---|---|---|---|
| 8,522,608 | B2 | 9/2013 | Odendall | |
| 8,826,722 | B2 | 9/2014 | Odendall | |
| 2001/0025485 | A1* | 10/2001 | Kobayashi | F02D 41/0295 60/285 |
| 2001/0045089 | A1* | 11/2001 | Kobayashi | F02D 41/0295 60/274 |
| 2004/0103642 | A1* | 6/2004 | Rosel | F02D 41/1441 60/274 |
| 2004/0244364 | A1* | 12/2004 | Makki | F01N 11/002 60/285 |
| 2007/0095051 | A1 | 5/2007 | Iihoshi et al. | |
| 2010/0108046 | A1 | 5/2010 | Nakagawa et al. | |
| 2012/0031075 | A1 | 2/2012 | Odendall | |
| 2012/0053816 | A1 | 3/2012 | Odendall | |
| 2013/0103285 | A1* | 4/2013 | Zimmerschied | F02D 41/1402 701/102 |
| 2013/0338904 | A1* | 12/2013 | Onoe | F02D 41/0295 701/103 |
| 2014/0358355 | A1* | 12/2014 | Zimmerschied | F02D 41/1495 701/31.1 |

FOREIGN PATENT DOCUMENTS

| | | |
|---|---|---|
| DE | 601 16 158 | 6/2006 |
| DE | 102005038492 | 2/2007 |
| DE | 102006051465 | 5/2007 |
| DE | 102009007572 | 8/2010 |
| JP | 2003-148207 | 5/2003 |
| WO | WO 2008/125952 | 10/2008 |
| WO | WO 2010/089181 | 8/2010 |
| WO | WO 2012/098641 | 7/2012 |

OTHER PUBLICATIONS

Chinese Search Report issued on Jun. 8, 2016 with respect to counterpart Chinese patent application 201380053001.6.
Translation of Chinese Search Report issued on Jun. 8, 2016 with respect to counterpart Chinese patent application 201380053001.6.

* cited by examiner

METHOD FOR OPERATING AN INTERNAL COMBUSTION ENGINE AND CORRESPONDING INTERNAL COMBUSTION ENGINE

CROSS-REFERENCES TO RELATED APPLICATIONS

This application is the U.S. National Stage of International Application No. PCT/EP2013/003074, filed Oct. 12, 2013, which designated the United States and has been published as International Publication No. WO 2014/056625 and which claims the priority of German Patent Application, Serial No. 10 2012 019 907.4, filed Oct. 11, 2012, pursuant to 35 U.S.C. 119(a)-(d).

BACKGROUND OF THE INVENTION

The invention relates to a method for operating an internal combustion engine with an exhaust gas purifying device, wherein the exhaust gas purifying device has a catalytic converter through which an exhaust gas stream of the internal combustion engine can be conducted and a first lambda probe arrange upstream of the catalytic converter in the exhaust gas stream and a second lambda probe arranged in the exhaust gas stream arranged upstream of the catalytic converter, wherein as first lambda probe (5) a broadband lambda probe and as a second lambda probe (6) a binary lambda probe is used. The invention also relates to an internal combustion engine.

The method serves for operating the internal combustion engine or respectively the exhaust gas purifying device assigned to the internal combustion engine. Exhaust gas, which is exhausted by the internal combustion engine and generated during the combustion of fuel is at least partially purified of pollutants by means of the exhaust gas purifying device. For this purpose the exhaust gas purifying device has at least one catalytic converter through which exhaust gas of the internal combustion engine can be conducted in the form of the exhaust gas stream. Further, two lambda probes are assigned to the exhaust gas purifying device, wherein the first lambda probe is arranged upstream of the catalytic converter and the second lambda probe is arranged downstream of the catalytic converter, so that the oxygen content of the exhaust gas can be determined at the respective position upstream or downstream of the catalytic converter. For this purpose the first and the second lambda probe protrude into the exhaust stream. The first lambda probe provides a first lambda signal and the second lambda probe a second lambda signal, wherein a first lambda value can be determined from the first lambda signal and a second lambda value can be determined from the second lambda signal.

The catalytic converter has an oxygen storage or respectively operates as such. This means that when a lean exhaust gas is present—i.e., in the case of an oxygen excess at combustion of $\lambda$ greater than one—oxygen transitions from the exhaust gas into the oxygen accumulator and is intermittently stored therein. On the other hand when a rich exhaust gas—resulting from the combustion with fuel excess with $\lambda$ smaller than one—is present, oxygen is removed from the oxygen accumulator. This ensures at least over a certain period of time that the stoichiometric ratio with $\lambda=1$ required for the purification of exhaust gas can at least approximately be provided. Correspondingly the quality of the catalytic converter can for example be determined by way of the oxygen storage capacity. Preferably the oxygen storage capacity is determined periodically.

In particular the lambda probe arranged upstream of the catalytic converter often only has a low accuracy. For example the first lambda signal provided by the first lambda probe deviates by a defined value, the so-called offset, from the conditions actually existing in the exhaust gas at the site of the first lambda probe. Due to this error it may occur that the internal combustion engine is set to a composition of a fuel air mixture supplied to the internal combustion engine, which deviates from the one that would be required to achieve a good or better converting efficiency in the catalytic converter. Correspondingly the goal is to compensate the error of the first lambda probe or the offset as quickly as possible. This can for example be accomplished by means of a controller, which regulates the signal provided by the second lambda probe to a lambda target value. This regulation however can only be conducted with a very slow regulation speed because when using a higher regulation speed regulation oscillations occur which in turn themselves lead to a poorer converting efficiency of the catalytic converter.

SUMMARY OF THE INVENTION

It is therefore an object of the invention to set forth a method for operating an internal combustion engine which does not have the aforementioned disadvantage but in particular always achieves a high converting efficiency of the catalytic converter, to which end the lambda signal of the first lambda probe which may be subject to errors, is corrected.

According to the invention this is achieved with a method with the features of the independent patent claim. It is provided that an oxygen filling state of an oxygen storage of the catalytic converter is determined by way of a first lambda signal provided by the first lambda probe and an offset value, and when a second lambda signal provided by the second lambda probe falls below a lower lambda signal threshold the oxygen filling state of the oxygen storage is set to a first value corresponding to an empty oxygen storage and/or when the second lambda signal exceeds an upper lambda signal threshold the filling state of the oxygen storage is set to a second value corresponding to a full oxygen storage, and immediately thereafter during at least one regulation time period the offset value is adjusted by way of the second lambda signal. The oxygen filling state of the oxygen storage is for example determined by means of a model. Hereby an integration of an oxygen influx into the catalytic converter or efflux out of the catalytic converter is preferably performed based on a starting value.

Correspondingly the accuracy of the oxygen storage filling state strongly depends on the accuracy of the first lambda signal. Because as mentioned the first lambda signal is often subject to an offset, the first lambda signal is corrected with the offset value. The oxygen filling state thus takes into account a value, which is determined from the first lambda signal and the offset value, for example by addition. As a result of the integral determination of the oxygen filling state, the deviation of the first lambda signal from the conditions actually present in the exhaust gas is also integrated so that the error of the oxygen storage filling state increases over time. This is at least partially prevented by using the offset value because the latter—after corresponding setting—corrects the first lambda signal towards the actually existing conditions.

Correspondingly however it is required to determine the offset value in order to be able to perform an accurate correction of the first lambda signal. In this determination use is made of the circumstance that when the first lambda signal has the offset and a mixture composition deviating from the stoichiometric ratio $\lambda=1$ is set at the internal combustion engine for correspondingly achieving a desired oxygen filling state, the second lambda probe indicates at least after a defined time period either an air deficiency or air excess in the exhaust gas. Thus the second lambda signal allows drawing a more accurate conclusion regarding the filling state of the oxygen storage of the catalytic converter than with the first lambda signal which has the offset.

When the second lambda signal falls below the lower lambda signal threshold, the oxygen filling state is set to the first value, which corresponds to the empty oxygen storage. When on the other hand the second signal exceeds the upper lambda signal threshold the oxygen filling state is set to the second value. The second value corresponds to the full oxygen storage. The lower lambda signal threshold and the lambda upper signal threshold are usually selected to be different and are for example constant. Of course they can also however be selected in dependence on an operating state of the internal combustion engine. The oxygen filling state of the oxygen storage is thus set back to a defined value which was determined by means of the second lambda signal. This is because when the second lambda signal falls below the lower lambda signal threshold it can be assumed that the oxygen storage is actually empty. Correspondingly it can analogously be assumed when the upper lambda signal threshold is exceeded that the oxygen storage is full. The time point at which such a setting back of the oxygen filling state occurs is intermittently stored for example by a control device by means of which the method is performed.

After this setting back of the oxygen filling state the mixture composition set at the internal combustion engine is controlled and/or regulated so that the target filling state is established at the oxygen storage over the regulation time period, wherein the oxygen filling state which was for example determined by means of the model corresponds to the target filling state. Preferably the target filling state is between the first value and the second value, for example exactly in the middle between these two values, in particular also at an oxygen filling state of 50%. The regulating occurs usually by way of the first lambda signal, which reflects the conditions present in the exhaust gas upstream of the catalytic converter. During the regulation time period the balancing of the oxygen filing state is thus further performed according to the description above, however, starting from the oxygen filling state determined at the beginning of the regulation time period, i.e., either the first value or the second value. It is noted that the oxygen filling state determined in this way does not necessarily correspond to the oxygen filings state actually present in the oxygen storage.

At the end of the regulation time period the offset parameter is now adjusted by way of the second lambda signal. When the parameter which was determined form the first lambda signal and the offset parameter substantially accurately reflects the conditions present in the exhaust gas upstream of the catalytic converter an actual oxygen filling state is present at the end of the regulation time period which corresponds to the target filling state. This means that a defined amount of oxygen is stored in the oxygen storage. Correspondingly the second lambda signal will indicate a stoichiometric ratio in the exhaust gas downstream of the catalytic converter independent of the first lambda signal. When this is the case no correction of the offset parameter is required, thus the offset parameter is only adjusted if at all, in which the offset parameter is not or only insignificantly changed.

When on the other hand the second lambda signal indicates an oxygen deficiency or oxygen excess, the calculated oxygen filling state corresponds to the target filling state, however the oxygen storage is actually either completely full or completely empty. Correspondingly it can be concluded that the combination of the first lambda signal with the offset parameter does not reflect the actual conditions present in the exhaust gas. The offset parameter is thus corrected with a value, which depends on whether the second lambda signal is greater than one or smaller than one. Preferably the adjustment only occurs when the second lambda signal falls below the lower lambda signal threshold or exceeds the upper lambda signal threshold in particular continues to be below below or to exceed it.

In an advantageous embodiment of the invention, it is provided that for adjusting the offset value, the offset value is incremented by a differential value when the second lambda signal corresponds to a lean mixture composition at the end of the regulation time period and/or is decremented by the differential value when the second lambda signal corresponds to a rich mixture composition at the end of the regulation time period. When an air excess is thus detected by means of the second lambda probe, the offset value is increased by the differential value. When an oxygen deficiency is present downstream of the catalytic converter on the other hand, the offset value is decreased by the differential value. The differential value can be constant or can be defined in dependence on an operating parameter or a state parameter of the internal combustion engine.

The lambda differential variable at least approximately represents the difference between the combination of the first lambda signal and the offset value and the actual conditions existing in the exhaust gas. For example a lambda differential variable, which is determined from the target filling state, an exhaust gas measurement stream and the duration of the regulation time period represents a minimal deviation. The target filling state is the state to which the oxygen storage of the catalytic converter is to be set or regulated within the regulation time period. It thus indicates the amount of oxygen which is to be intermittently stored in the oxygen storage after the regulation time period.

The exhaust measurement stream describes the amount, in particular the mass, of the exhaust gas flowing through the catalytic converter per time unit. From the exhaust gas mass stream and the duration of the regulation time period the mass of the exhaust gas flowing through the catalytic converter within the regulation time period can thus be determined. The mass of the oxygen stored at least theoretically in the oxygen storage results from the relationship $$\dot{m}_{O2}=(\lambda-1)-\dot{m}-\Delta t,$$

wherein $\lambda$ corresponds to a lambda value, $\dot{m}$ to the exhaust gas mass flow and $\Delta t$ to the duration of the regulation time period. The lambda differential parameter $\Delta\lambda$ can now for example be determined from the relationship $$\Delta\lambda = 1 + \frac{\Delta m_{02}}{\dot{m}\cdot\Delta t},$$

wherein the used values correspond to the ones defined above. The basis for the determination is the oxygen mass difference $\Delta m_{O2}$, which describes the mass of the oxygen to be introduced into or removed from the oxygen storage. It thus preferably corresponds to the target filling state or is at least determined therefrom.

When considering this relationship it becomes clear that the lambda differential variable minus one, i.e., $\Delta\lambda-1$ is reciprocal to the exhaust gas mass flow and to the duration of the regulation time period, while it is proportional to the oxygen mass difference. The latter is for example selected only in dependence on the used catalytic converter or the oxygen storage capacity of the oxygen storage, i.e., it is preferably constant for sequential regulation time periods. When the duration of the regulation time period is also constant, the parameter $\Delta\lambda-1$ also essentially depends on the exhaust gas mass flow.

The lambda differential variable can for example be determined at the end of the regulation time period from a temporal mean of the exhaust gas mass flow over the regulation time period. As an alternative of cause also a temporally resolved determination of the lambda differential variable regarding the exhaust gas mass flow can be provided by integrating or adding up at defined time points during the regulation time period. In this way the accuracy of the determination of the lambda differential variable can be further improved.

In a refinement of the invention it is provided that the differential value is constant or is determined in dependence on the lambda differential variable and/or in dependence on a gradient of the second lambda signal in the regulation time period. The differential value, by means of which the offset value is adjusted, can thus be selected to be constant. For example it is added to or subtracted from the current offset value in dependence on the sign of the second lambda signal at the end of the regulation time period. With a constant differential value, however no adaption for example in dependence in the difference between the value determined from the second lambda signal and the actual conditions in the exhaust gas is possible. Therefore the differential value is preferably determined variable in dependence on at least one variable.

Such a variable is for example the lambda differential variable, to which the differential value can correspond. In addition or as an alternative the differential value depends on the gradient of the second lambda signal. When the conditions that actually exist downstream of the catalytic converter are still far removed from a stoichiometric ratio, a great gradient results from the regulation to the target filling state during the regulation time period. The reason for this is that the oxygen storage has at most only a small effect in a range significantly deviating from the stoichiometric ratio. When on the other hand the actual conditions are already close to the stoichiometric ratio, i.e., when $\lambda$ is already approximately equal to one, the effect of the oxygen storage is significantly greater. Thus the second lambda signal reacts with a smaller gradient to the change of the mixture composition for regulation to the target filing state. For example a maximal value of the gradient present during the regulation time period is used for determining the differential value. As an alternative of course also a temporal mean value of the gradient over the regulation time period can be used.

For example it can be provided that the differential value is determined by means of a controller, which has at least one proportional member, an integral member and/or a differential member. This way of determining the differential value is in particular used when the differential value is variable, i.e., when it depends on the lambda differential parameter and/or the gradient of the second lambda signal.

In an embodiment of the invention it is provided that the duration of the regulation time period is constant or is selected in dependence on at least one operating parameter of the internal combustion engine, in particular the first lambda signal and/or the second lambda signal. The duration of the regulation time period is—when the latter is selected constant—always greater than zero and is for example at least 1 s, at least 2 s, at least 3 s, at least 4 s or at least 5 s. As an alternative a variable selection of the duration can also be provided for example in dependence on the operating variable. As operating variable preferably at least one of the two lambda signals is used, in particular the second lambda signal of the second lambda probe arranged downstream of the catalytic converter. For example a starting value of the lambda signal is defined at the beginning of the regulation time period, i.e., the starting value is set to the lambda signal present at this time point. During the regulation time period a differential value of the actual lambda signal is continuously determined from the starting value. The maximal value of the differential value during the regulation time period is stored in the form of a maximal differential value; i.e., depending on whether the oxygen filing state is set to the first or second value, a minimal value or a maximal value of the lambda signal.

When the lambda signal corrected by the offset value does not correspond to the actual conditions, the lambda signal is changed again toward the starting value after exceeding the maximal difference. When the (momentary) differential value falls below the maximal value or when a difference between the (momentary) differential value and the maximal value exceeds a defined threshold value, which is different from zero, the regulation time period is terminated and the offset value is adjusted as described. Because the course of the differential value indicates that the offset was not completely compensated by means of the offset value, the process is preferably immediately repeated, i.e., the oxygen filling state is set to the first value or the second value and during a further regulation time period it is again regulated to the target filling state and at the end of the further regulation time period the offset value (if required) is corrected.

It can further be provided that the oxygen filling state is determined by means of a model, in particular integral from the first lambda signal. Such an approach was already described above. Preferably the oxygen filling state is thus determined solely based on the first lambda signal so that the second lambda signal is not taken into account. This is sufficient to determine a balance of the oxygen influx into the oxygen storage and the oxygen removal from the oxygen storage. However, it can also be provided to also take the second lambda signal into account beside the first lambda signal for determining the oxygen filling state. In this way the accuracy can be further increased because also the amount of the oxygen exiting the catalytic converter can be determined more accurately. When the second lambda probe is configured as lambda probe a linearization of the second lambda signal can be performed for this purpose. The determination of the oxygen filling state occurs particularly preferably integral, i.e., based on a defined value, for example the first value or the second value, which is used for resetting the oxygen filling state under the mentioned conditions.

A further advantageous embodiment of the invention provides that the setting of the oxygen filling state to the first value of the second value and the subsequent regulation to the target filling state is performed multiple times. In this way the offset value can be corrected so that after the repeated performance of the mentioned steps the combination of the first lambda signal and the offset value corresponds exactly or at least approximately to the conditions actually present in the exhaust gas.

Finally it can be provided that to the target filling state is set to a value between the first value at the second value. It is at least provided that the target filling state deviates from the first value as well as from the second value. Preferably the deviation is a great as possible in order to make the distance bridged as a result of the regulating during the regulation period as great as possible. Correspondingly the target filling state is preferably exactly set between the first and the second value, for example to 50%.

The invention also relates to an internal combustion engine, in particular for implementing the method described above, with an exhaust gas purifying device, wherein the exhaust gas purifying device has a catalytic converter through which an exhaust gas stream of the internal combustion engine can flow and a first lambda probe arranged upstream of the catalytic converter in the exhaust gas stream and a second lambda probe arranged in the exhaust gas stream downstream of the catalytic converter.

Hereby it is provided that a broadband lambda probe is used as first lambda probe and/or a binary lambda probe is used as second lambda probe. The binary lambda probe has compared to the broadband lambda probe only a relatively small lambda window, within which the lambda signal changes. For example the lambda window of the binary lambda probe is within a range of approximately 0.98 to 1.02 within which the lambda signal provided by the lambda probe changes. Outside of this lambda window on the other hand the lambda signal remains constant. By means of the broadband lambda probe on the other hand a lambda window can be covered that is multiple times greater than the lambda window of the binary lambda probe. For example the lambda window of the broadband lambda probe is within a range which is delimited by a lower threshold and an upper threshold, wherein the lower threshold is for example 0.8 to 0.9 and the upper threshold 1.1 to 1.2. Of course, both lambda probes can either be configured as broadband lambda probe or as binary lambda probe. Particularly preferably, however, the first lambda probe is configured as broadband lambda probe and the second lambda probe as binary lambda probe.

Hereby a control device of the internal combustion engine is configured to determine an oxygen filling state of an oxygen storage of the catalytic converter by means of a first lambda signal provided by the first lambda probe and an offset variable, to set the oxygen filling state to a first value corresponding to an empty oxygen storage when a second lambda signal provided by the second lambda probe falls below a lower lambda signal threshold and/or to set the oxygen filling state to a second value corresponding to a full oxygen storage when the second lambda signal exceeds a upper lambda signal threshold and immediately thereafter during at least one regulation time period to regulate the oxygen filling level to a target filling level, wherein at the end of the regulation time period the offset variable is adjusted by way of the second lambda signal. The advantages of such an approach were already discussed above. The internal combustion engine and the method used for its operation can be refined according to the description above and hence reference is made to this description.

In the following, the invention is explained in more detail by way of exemplary embodiments shown in the drawing without limiting the invention. It is shown in:

BRIEF DESCRIPTION OF THE DRAWING

FIG. 1 shows a region of an exhaust gas purifying device 1, which is a component of an internal combustion engine 2. Exhaust gas flows through the exhaust gas purifying device 1 in the direction of the arrow 3. The exhaust gas purifying device 1 has at least one catalytic converter 4, which has an oxygen storage or respectively has the capability to store oxygen. Relative to the exhaust gas a first lambda probe 5 is provided upstream of the catalytic converter 4 and a second lambda probe 6 downstream of the catalytic converter. The exhaust gas coming from the internal combustion engine 2 thus first flows over the first lambda probe 5, then flows though the catalytic converter 4 and subsequently flows over the second lambda probe 6. By means of the first lambda probe 5 the residual oxygen content of the exhaust gas can thus be determined upstream of the catalytic converter 4 and by means of the second lambda probe 6 downstream of the catalytic converter 4.

DETAILED DESCRIPTION OF PREFERRED EMBODIMENTS

By way of a first lambda signal provided by the first lambda probe 5 an oxygen filling state of the oxygen storage of the catalytic converter 4 is to be determined. In addition an offset value $\Delta\lambda$ is taken into account by means of which an offset or an offset error of the first lambda probe 5 can ideally fully be compensated. For determining the offset value $\Delta\lambda$ a second lambda signal, in particular provided by the second lambda probe 6, is used. When this second lambda signal falls below a lower lambda signal threshold the oxygen filling state is set to a first value, which corresponds to an empty oxygen storage. On the other hand when the second lambda signal exceeds an upper lambda signal threshold the oxygen filling state is set to a second value, which indicates a full oxygen storage.

Subsequently, in particular immediately subsequently, to this resetting of the oxygen filling state, the internal combustion engine is operated so that the oxygen filling state determined by the first lambda signal is set or regulated over a regulation time period to a target filling state. At the latest at the end of the regulation time period also the calculated oxygen filling state is to correspond to the target filling state. This however does not mean that the actual oxygen filling state also equals the target filling state. When at the end of the regulation time period the second lambda signal still deviates from the stoichiometric ratio it is concluded that the combination of the first lambda signal and the offset variable $\Delta\lambda$ does not reflect the conditions that are actually present in the exhaust gas. Correspondingly the offset variable $\Delta\lambda$ is adjusted by way of the second lambda signal. The described steps are preferably repeated multiple times until the second lambda signal at the end of the regulation time period reaches a desired value, in particular $\lambda=1$ or is at least within a range around this value, i.e., for example neither falls below the lower lambda signal threshold nor exceeds the upper lambda signal threshold. The lower lambda signal threshold as well as the upper lambda signal threshold are different from 1, wherein the lower lambda signal threshold is smaller than one and the upper lambda signal threshold is greater than one.

Figure 1:
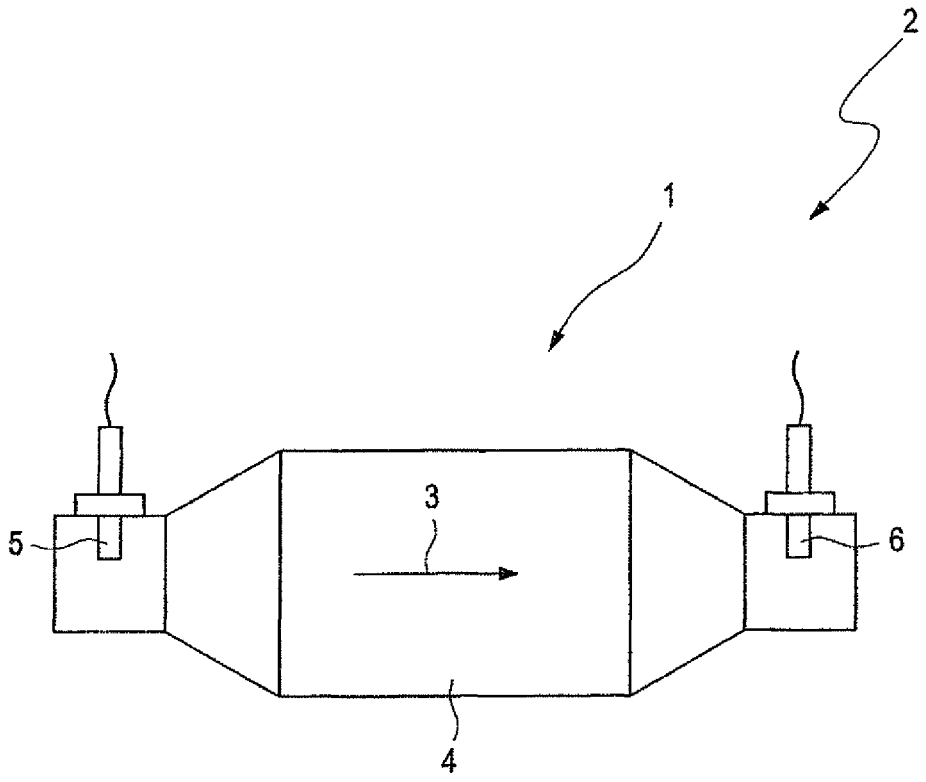
FIG. 1 a schematic representation of a region of an exhaust gas purifying device with a catalytic converter and a first lambda probe and a second lambda probe, and FIG. 2 three diagrams, wherein in a first diagram a course of a first lambda signal provided by the first lambda probe is plotted in a first diagram, in a second diagram the course of a lambda signal provided by the second lambda probe and in a third diagram an offset value in each cases plotted over time.
Figure 2:
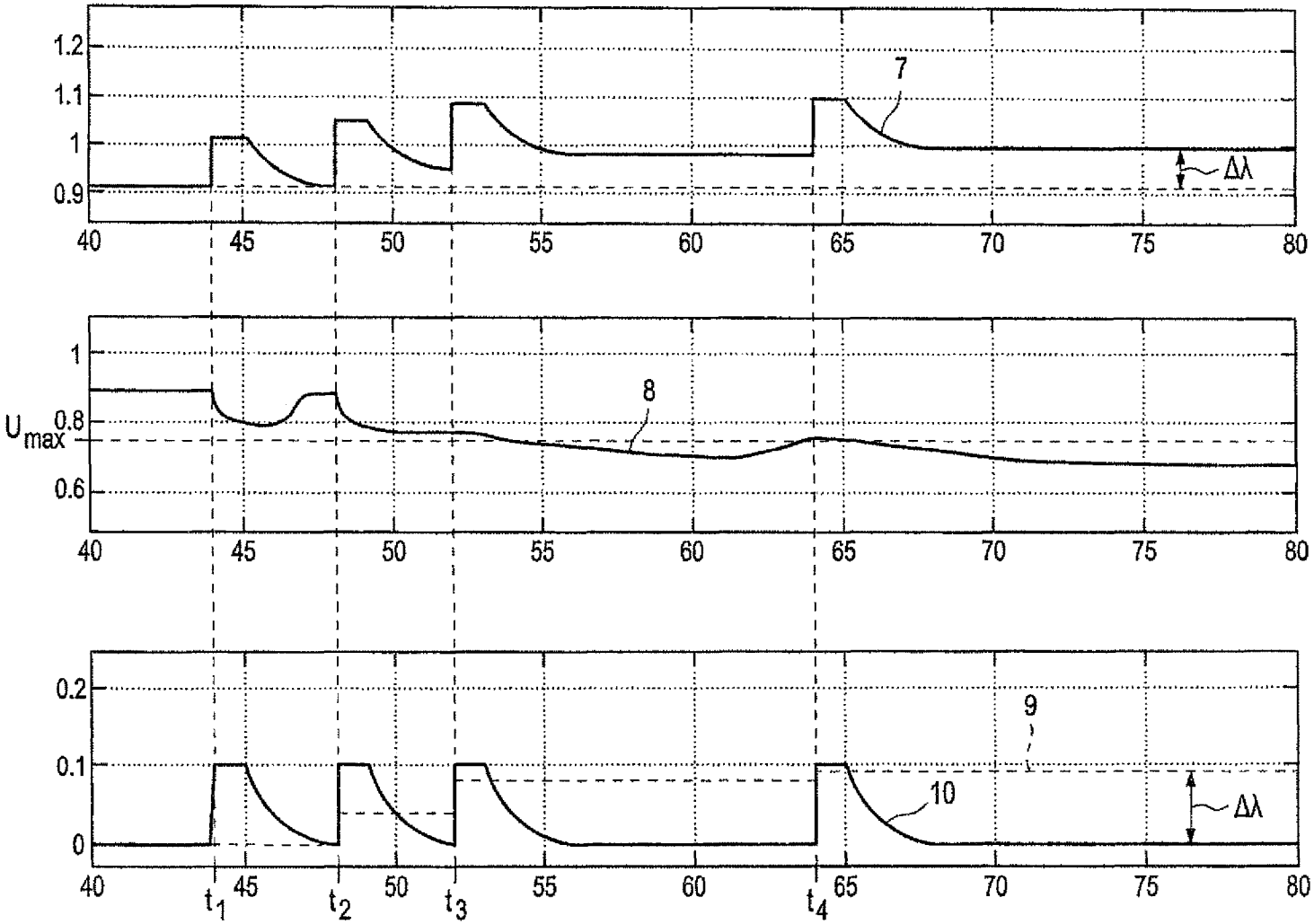

FIG. 2 shows three diagrams, wherein in the uppermost diagram a course 7 represents a first lambda value over time, wherein the first lambda value is composed of the lambda signal provided by the first lambda probe 5 and the offset variable $\Delta\lambda$. The middle diagram shows a course 8 of the second lambda signal provided by the second lambda probe 6 over time. While the first lambda value of the uppermost diagram is shown without unit, the second lambda signal has the unit volt, i.e., it directly represents the output signal of the second lambda probe. In the bottommost diagram two courses 9 and 10 are shown, wherein the course 9 represents the offset value $\Delta\lambda$ over time and the course 10 a regulatory variable over time. In this context it has to be noted that in particular the shown time scale but also the further variables are purely exemplary and only serve for explaining the method according to the invention.

For the second lambda signal a lower lambda signal threshold $\lambda_{min}$ or a corresponding voltage $U_{max}$ is determined, which is shown in the middle diagram. The lower lambda signal threshold is below a lambda target value, the voltage $U_{max}$ is thus above a corresponding voltage which in the shown her exemplary embodiment is about 650 mV. When the second lambda signal exceeds this target voltage an oxygen filling state is set to a value, which corresponds to an empty oxygen storage. This is the case at the time points $t_1$, $t_2$, $t_3$ and $t_4$. Subsequently the mixture composition of a fuel air mixture, which is supplied to the internal combustion engine is set so that the oxygen filling level which is subsequently calculated by means of a model is regulated to a target filling state which for example corresponds to 50% of the second value, which correspond to the full oxygen storage. The course of the corresponding regulation variable can be seen form the course 10.

Because the regulation is designed to change the oxygen filling state toward the target filling state, i.e., in the here shown exemplary embodiment to supply oxygen to the empty oxygen storage, a lean mixture composition is set. This influences the first lambda signal, which thus strongly increases at the mentioned time points and according to the course 10 of the regulation variable also decreases again. The regulation occurs over a defined regulation time period, which for example has the length of 5 seconds. The temporal distances between the time periods $t_1$, $t_2$ and $t_3$ thus correspond to the duration $\Delta t$ of the regulation time period. At the end of the respective regulation time period the offset value $\Delta\lambda$ is adjusted by way of the second lambda signal. This means that the second lambda signal is tested regarding whether it still indicates a composition of the exhaust gas, which deviates from a stoichiometric ratio. In particular it is tested whether the second lambda signal still falls below the lower lambda signal threshold or exceeds the corresponding voltage upper threshold $U_{max}$.

When this is the case the offset value $\Delta\lambda$ is adjusted according to the course 9, for example by adding a differential value. This differential value can for example be determined in dependence on a lambda differential variable, which is composed of the target filling state, an exhaust gas mass stream and the duration of the regulation time period. Analogous to the course 9 of the offset value $\Delta\lambda$, the first lambda value which is shown by means of the course 7 in the uppermost diagram and which is composed of the first lambda signal and the offset value $\Delta\lambda$, also shifts. It can be recognized that after multiply performing the above described correction the first lambda value is almost 1 and is different from its starting value by the offset value $\Delta\lambda$.

In the exemplary embodiment described above the duration $\Delta t$ of the regulation time period is constant. As an alternative however it can also be determined variable in dependence on an operating variable of the internal combustion engine or the exhaust gas purifying device. Preferably, the second lambda signal is used as operating variable. In particular it is provided that a lambda signal present at the beginning of the regulation time period is defined as starting value. Now a differential value of the actual lambda signal is continuously determined from this starting value. The maximal value of the differential value during the regulation time period is defined in the form of a maximal differential value. At the beginning of the regulation time period the maximal differential value is thus preferably set to a small value, for example zero. When the current differential value is greater than the maximal differential value, the maximal differential value is set equal to the differential value, otherwise it remains unchanged.

When the differential value falls below the maximal differential value or when a difference between the differential value and the maximal differential value exceeds a defined threshold value that is different form zero, the regulation time period is terminated and the offset value adjusted. When such a course of the differential value is present, the offset was not completely compensated by the offset value in the regulation time period. Correspondingly the described approach is preferably repeated for further adjustment of the offset value to the offset of the first lambda signal.

With the described method an error of the first lambda probe can be determined fast and accurately and removed without the risk of controller oscillations. The internal combustion engine thus adjusts to the offset error of the first lambda probe 5 and can subsequently be operated so that its exhaust gas can at least to the most degree be cleared of the pollutants, which are converted in the catalytic converter 4.

What is claimed is:

1. A method for operating an internal combustion engine having an exhaust gas purifying device, comprising:

determining an oxygen filling state of an oxygen storage of a catalytic converter of the exhaust gas purifying device by way of a first lambda signal provided by a first lambda probe and an offset value, said first lambda probe being constructed as a broadband lambda probe and arranged upstream of the catalytic converter in an exhaust gas stream conductible through the catalytic converter;

when a second lambda signal provided by a second lambda probe arranged in the exhaust gas stream downstream of the catalytic converter falls below a lower lambda signal threshold, setting the oxygen filling state to a first value corresponding to an empty oxygen storage and/or when the second lambda signal exceeds a upper lambda signal threshold setting the oxygen filling state to a second value corresponding to a full oxygen storage, said second lambda probe being constructed as a binary lambda probe;

immediately after setting the oxygen filling state to the first value or the second value regulating the oxygen filling state during at least one regulation time period to a target filling state; and after expiration of the regulation time period adjusting the offset value by way of the second lambda signal.

2. The method of claim 1, wherein for adjusting the offset value, the offset value is incremented by a differential value, when after expiration of the regulation time period the second lambda signal corresponds to a lean mixture composition, and/or is decremented by the differential value when the second lambda signal after expiration of the regulation time period corresponds to a rich mixture composition.

3. The method of claim 2, wherein the differential value is constant or is determined in dependence on a lambda differential variable which is determined from target filling state, an exhaust gas mass stream and the duration of the regulation time period and/or in dependence on a gradient of the second lambda signal in the regulation time period.

4. The method of claim 1, wherein a duration of the regulation time period is constant or is selected in dependence on at least one operating variable of the internal combustion engine, in particular the first lambda signal and/or the second lambda signal.

5. The method of claim 1, wherein the oxygen filling state is determined by means of a model, in particular integral, from the first lambda signal.

6. The method of claim 1, wherein the setting of the oxygen filling state to the first value or the second value and the subsequent regulation to the target filling state is performed multiple times.

7. The method of claim 1, wherein the target filling state is set to a value between the first value and the second value.

8. An internal combustion engine, in particular for performing the method of claim 1, comprising:

an exhaust gas purifying device having a catalytic converter through which an exhaust gas stream of the internal combustion engine is conductible;

a first lambda probe constructed as a broadband lambda probe and arranged upstream of the catalytic converter in the exhaust gas stream;

a second lambda probe constructed as a binary lambda probe and arranged downstream of the catalytic converter in the exhaust gas stream, a control device of the internal combustion engine configured to a) determine an oxygen filling state of an oxygen storage of the catalytic converter by way of a first lambda signal provided by the first lambda probe and an offset value, b) set the oxygen filling state to a first value which corresponds to an empty oxygen storage when a second lambda signal which is provided by the second lambda probe falls below a lower lambda signal threshold and/or to set the oxygen filling state to a second value, which corresponds to a full oxygen storage when the second lambda signal exceeds an upper lambda signal threshold, and immediately thereafter during at least one regulation time period, and c) to regulate the oxygen filling state to a target filling state, wherein at the end of the regulation time period the offset value is adjusted by way of the second lambda signal.

* * * * *